US010390635B2

(12) United States Patent
Zender et al.

(10) Patent No.: US 10,390,635 B2
(45) Date of Patent: Aug. 27, 2019

(54) CARRIER BAG DISPENSERS, CARRIER BAG DISPENSER CAROUSEL, HOLD MEMBER FOR HOLDING AND RETAINING A MULTITUDE OF PAIRS OF STRAPS CONNECTED TO RESPECTIVE CARRIER BAGS AND KIT-OF-PARTS CARRIER BAG DISPENSER FOR HOLDING A STACK OF CARRIER BAGS

(71) Applicant: Mettler Packaging LLC, Raynham, MA (US)

(72) Inventors: Willibrord Zender, Waldweiler (DE); Gerhard Janzen, Morbach (DE)

(73) Assignee: Mettler Packaging LLC, Raynham, MA (US)

( * ) Notice: Subject to any disclaimer, the term of this patent is extended or adjusted under 35 U.S.C. 154(b) by 0 days.

(21) Appl. No.: 15/625,990

(22) Filed: Jun. 16, 2017

(65) Prior Publication Data

US 2018/0360238 A1 Dec. 20, 2018

(51) Int. Cl.

| | |
|---|---|
| ***A47F 9/04*** | (2006.01) |
| ***B65D 33/00*** | (2006.01) |
| ***B65D 33/06*** | (2006.01) |

(52) U.S. Cl.

CPC ..... *A47F 9/042* (2013.01); *B65D 33/001* (2013.01); *B65D 33/065* (2013.01)

(58) Field of Classification Search

USPC ... 248/99–101, 95, 617, 215, 301, 303–308, 248/322, 339, 229.12, 229.22; 211/85.15;

(Continued)

(56) References Cited

U.S. PATENT DOCUMENTS 2,631,803 A * 3/1953 Meyers ..... A47G 29/083 24/298
4,840,335 A * 6/1989 Forman, Jr. ..... B65B 67/1227 248/97

(Continued)

FOREIGN PATENT DOCUMENTS

WO WO-2009/141620 * 11/2009 ..... B65D 33/06

*Primary Examiner* — Christopher Garft
(74) *Attorney, Agent, or Firm* — Seed Intellectual Property Law Group LLP

(57) ABSTRACT

The present disclosure provides a carrier bag dispenser comprising a hold member arranged between a pair of struts for holding the carrying straps of a multitude of carrier bags, wherein said hold member has a support section, a fastening section and a separate retaining section, the latter two of which are resiliently connected, in some cases by at least one spring screw. The present disclosure further provides a carrier bag dispenser comprising a hold member arranged between a pair of struts for holding the carrying straps of a multitude of carrier bags, wherein said hold member has a support section, a fastening section and a retaining section having a front and a rear side wherein said rear side comprises a multitude of grooves extending from one side edge to the opposing side edge thereof. And, the present disclosure provides a carrier bag dispenser carousel comprising a multitude of carrier bag dispensers according to the present disclosure. Moreover, the present disclosure provides a hold member for holding and retaining a multitude of pairs of straps connected to respective carrier bags, wherein said hold member comprises a fastening section for fastening the hold member to a bag dispenser, a retaining section located, in regular use, above the fastening section having a front and a rear side and opposing side edges and a support section for the carrying straps located on the rear side of the hold member, wherein the retaining section and the fastening section of the hold member are separate (Continued)

elements which are resiliently connected, in some cases by at least one spring screw, or wherein the retaining section and the fastening section of the hold member are separate elements or are in one piece and wherein the rear side of the retaining section comprises a multitude of grooves extending from one side edge to the opposing side edge. Furthermore, the present disclosure provides a kit-of-parts carrier bag dispenser for holding a stack of carrier bags each having a pair of carrying straps and a pair of spaced apart holes in the upper region of the bag as well as for dispensing individual carrier bags comprising a T-shirt bag dispenser and a hold member according to the present disclosure.

19 Claims, 3 Drawing Sheets

(58) Field of Classification Search
USPC ..... 220/404
See application file for complete search history.

(56) References Cited

U.S. PATENT DOCUMENTS 4,840,336 A 6/1989 Stroh et al.
6,585,197 B1 * 7/2003 Daniels ..... A47F 9/042
206/554

* cited by examiner

CARRIER BAG DISPENSERS, CARRIER BAG DISPENSER CAROUSEL, HOLD MEMBER FOR HOLDING AND RETAINING A MULTITUDE OF PAIRS OF STRAPS CONNECTED TO RESPECTIVE CARRIER BAGS AND KIT-OF-PARTS CARRIER BAG DISPENSER FOR HOLDING A STACK OF CARRIER BAGS

BACKGROUND

Technical Field

The present disclosure relates to carrier bag dispensers, a carrier bag dispenser carousel comprising a multitude of carrier bag dispensers according to the present disclosure, a hold member for holding and retaining a multitude of pairs of straps connected to respective carrier bags, and a kit-of-parts carrier bag dispenser for holding a stack of carrier bags.

Description of Related Art

In WO 2009/141620 A1, a bag dispenser and bag combination is disclosed wherein the bag dispenser comprises first and second elongate arms spaced apart from one another and extending generally parallel one with the other, and a hook member arranged between said first and second arms, as well as a bag comprising front and rear layers forming a closed base end, closed sides and an open mouth end opposite the base end. A handle formation is arranged at the mouth end, generally centrally of the mouth end and spaced from the side edges of the bag. A pair of apertures is formed through the front and rear layers, the apertures being spaced apart from one another, one on either side of the handle formation and being arranged closer to the mouth end than the base end of the bag. The handle formation comprises a first handle part separate from and attached to the front layer of the bag and a second handle part separate from and attached to the rear layer of the bag, wherein said carrier bag being arranged on the dispenser so that the first and second arms extend through the apertures and the hook member retains the handle formation of the bag. In such a manner it is possible to effect mounting of said bag on an existing racking system previously used for mounting a stack of thin gauge vest-style or T-shirt bags.

Another existing racking or dispensing system for mounting a stack of vest-style or T-shirt bags is, for example, disclosed in U.S. Pat. No. 4,840,336. Said T-shirt bag dispenser is formed of a single length of wire having a middle portion and end portions with terminal ends and comprises a two-wire structure provided by bending each end portion of said single length of wire such that it lies on its middle portion with its opposing terminal ends secured together. The two-wire structure has a middle portion and end portions with protuberances formed on each end thereof by the bending of each said end portion of said single length of wire on its middle portion. Each of the end portions is bent at right angles to the middle portion to provide a support arm cantilevered forwardly from each end of the middle portion which forms the back of said two-wire structure. Furthermore, the protuberances on the ends of said cantilevered support arms serve as safety features. Each of said cantilevered support arms is provided with a continuous surface throughout the length thereof for mounting a stack of thin gauge vest-style or T-shirt bags. The dispenser can further comprise a hook centrally provided on the back of the rack over which horizontal slits provided on joined central tabs of the T-shirt bags in the stack can be placed.

It has been found that such existing racking or dispenser systems for vest-style or T-shirt bags do not provide satisfactory and reliable results during regular use when switching to carrier bags having a pair of carrying straps.

There has been a need prior to the present disclosure to extend the application spectrum of existing racking or dispenser systems for vest bags/T-shirt bags.

BRIEF SUMMARY

In at least one embodiment, described herein is a carrier bag dispenser of a first variant of the present disclosure having a front side and a rear side for holding a stack of carrier bags each having a pair of carrying straps and a pair of spaced apart holes in the upper region of the bag as well as for dispensing individual carrier bags therefrom. Said carrier bag dispenser comprises two spaced apart, essentially similarly or identically oriented or orientable holding struts for insertion into the pair of holes of the bags and a hold member having a front side and a rear side and arranged between the struts of the pair of holding struts for holding the carrying straps. Said carrier bag dispenser further comprises a carrier element to which the holdings struts of the pair of holding struts and the hold member are connected. The hold member of said carrier bag dispenser comprises a fastening section for fastening the hold member to the carrier element, a retaining section above the fastening section having a front and a rear side and opposing side edges and a support section for the carrying straps located on the rear side of the hold member. According to this first variant of a carrier bag dispenser of the present disclosure, the retaining section and the fastening section of the hold member are separate elements which are resiliently connected, in some cases by at least one spring screw.

By use of the this first variant of a carrier bag dispenser of the present disclosure, both the loading process of said dispenser with a multitude of carrier bags and the dispensing process of individual carrier bags can be carried out in a safer and more reliable manner being less prone to any intricacies. Without being bound by theory, it is presently believed that by resiliently connecting the fastening section and the retaining section of the hold member, in some cases by use of at least one spring screw, a connection is provided having a certain flexibility thereby absorbing and diverting inadvertent mechanical forces.

According to another, second variant of a carrier bag dispenser of the present disclosure which does not mandatorily rely on the retaining section and the fastening section of the hold member being separate elements which are resiliently connected, in some cases by at least one spring screw, the rear side of the retaining section comprises at least one groove and in some advantageous cases a multitude of grooves extending from one side edge to the opposing side edge. It has surprisingly been found that by use of such grooves the risk of a carrying strap or a pair of carrying straps inadvertently slipping over the retaining section it can be greatly reduced. This is also valid when a stack comprises a large number of carrier bags each comprising a pair of carrying straps is used with the carrier bag dispenser of the present disclosure.

The term "front side" in the meaning of the present disclosure means that side which faces the customer or sales personnel when taking a carrier bag from the carrier bag dispenser.

The terms "retaining," "fastening," and "support sections" can also be called retaining, fastening and support elements or members, respectively, for example when the retaining, fastening and support sections form or represent separate entities, i.e. are not formed in one piece.

In the meaning of the present disclosure, the terms "vest bag" and "T-shirt bag" are considered to be usable in a synonymous manner. The same should apply to the terms "vest bag dispenser" and "T-shirt bag dispenser."

And, in the meaning of the present disclosure, the term "carrier bag having a pair of carrying straps" is synonymous to the term "soft-loop carrier bag" or "soft-loop handle carrier bag." Thus, in the meaning of the present disclosure, a carrier bag dispenser for carrier bags each having a pair of carrying straps is synonymous to a "soft-loop carrier bag dispenser" or a "soft-loop handle carrier bag dispenser." And, carrying straps in the meaning of the present disclosure, are considered equivalent to so-called soft-loop handles.

The following items are examples of embodiments that may incorporate, employ, and/or otherwise take advantage of a carrier bag dispenser and related features as discussed in more detail herein.

Item 1. A carrier bag dispenser having a front side and a rear side for holding a stack of carrier bags each having a pair of carrying straps and a pair of spaced apart holes in the upper region of the bag as well as for dispensing individual carrier bags therefrom, comprising two spaced apart, essentially similarly or identically oriented or orientable holding struts for insertion into the pair of holes of the bags, a hold member having a front side and a rear side and arranged between the struts of the pair of holding struts for holding the carrying straps, and a carrier element to which the holdings struts of the pair of holding struts and the hold member are connected, wherein the hold member comprises a fastening section for fastening the hold member to the carrier element, a retaining section above the fastening section having a front and a rear side and opposing side edges and a support section for the carrying straps located on the rear side of the hold member, and wherein the retaining section and the fastening section of the hold member are separate elements which are resiliently connected.

Item 2. The carrier bag dispenser according to Item 1, wherein the rear side of the retaining section comprises a multitude of grooves extending from one side edge to the opposing side edge.

Item 3. The carrier bag dispenser according to Item 1 or 2, wherein the retaining section and the fastening section of the hold member are resiliently connected by at least one spring screw.

Item 4. A carrier bag dispenser having a front side and a rear side for holding a stack of carrier bags each having a pair of carrying straps and a pair of spaced apart holes in the upper region of the bag as well as for dispensing individual carrier bags therefrom, comprising two spaced apart, essentially similarly or identically oriented or orientable holding struts for insertion into the pair of holes of the bags, a hold member having a front side and a rear side and arranged between the struts of the pair of holding struts for holding the carrying straps, and a carrier element to which the holdings struts of the pair of holding struts and the hold member are connected, wherein the hold member comprises a fastening section for fastening the hold member to the carrier element, a retaining section above the fastening section having a front and a rear side and opposing side edges and a support section for the carrying straps located on the rear side of the hold member, and wherein the rear side of the retaining section comprises a multitude of grooves extending from one side edge to the opposing side edge.

Item 5. The carrier bag dispenser according to Item 4, wherein the hold member is made in one piece.

Item 6. The carrier bag dispenser according to Item 4 or 5, wherein the retaining section and the fastening section of the hold member are separate elements which are resiliently connected.

Item 7. The carrier bag dispenser according to any of Items 4 to 6, wherein the retaining section and the fastening section of the hold member are resiliently connected by at least one spring screw.

Item 8. The carrier bag dispenser according to any of the preceding Items, wherein the rear side of the retaining section comprises two, three, four, five or six grooves that extend from one side edge to the opposing side edge.

Item 9. The carrier bag dispenser according to any of the preceding Items, wherein at least one groove of the multitude of grooves in cross-sectional view is tilted upwards.

Item 10. The carrier bag dispenser according to any of the preceding Items, wherein the retaining section, in use, i.e., regular use, is essentially vertically oriented.

Item 11. The carrier bag dispenser according to any of the preceding Items, wherein the retaining section and the support section are forming an angle in the range from 60° to 120°.

Item 12. The carrier bag dispenser according to Item 3 or 7, wherein the at least one spring screw is located on the front side of the retaining section and wherein the fastening section comprises at least one corresponding screw thread.

Item 13. The carrier bag dispenser according to Item 3, 7 or 12, wherein the at least one spring screw is located in the lower part of the retaining section and/or wherein the at least one screw thread is located in the upper part of the fastening section.

Item 14. The carrier bag dispenser according to any of Items 3, 7, 12 or 13, wherein that section of the spring screw being positioned in the screw thread is additionally fixed to the screw thread by use of glue.

Item 15. The carrier bag dispenser according to any of the preceding Items, wherein the fastening section and the support section are formed in one piece.

Item 16. The carrier bag dispenser according to any of the preceding Items, wherein the support section and the fastening section are formed in one piece and resiliently connected to the separate retaining section, or wherein the support section and the retaining section are formed in one piece and resiliently connected to the separate fastening section.

Item 17. The carrier bag dispenser according to any of the preceding Items, wherein the fastening section is fastened to the carrier element by at least one screw or by gluing or welding.

Item 18. The carrier bag dispenser according to Item 17, wherein the at least one spring screw has a lesser extension in the direction away from the front side as the at least one screw which fastens the fastening section to the carrier element.

Item 19. The carrier bag dispenser according to any of the preceding Items further comprising a stack of carrier bags each having a pair of carrying straps and a pair of spaced apart holes in the upper region of the bags wherein the pair of struts is placed in the respective pair of spaced apart holes and the pairs of carrying straps are held by the hold member.

Item 20. The carrier bag dispenser according to Item 16, wherein the transition from the fastening section to the support section on the front side is rounded or wherein the transition from the retaining section to the support section on the front side is rounded.

Item 21. A carrier bag dispenser carousel comprising two, three, four, five or more carrier bag dispensers according to any of the preceding Items.

Item 22. A hold member for holding and retaining a multitude of pairs of straps connected to respective carrier bags, wherein said hold member comprises a fastening section for fastening the hold member to a bag dispenser, a retaining section located, in use, i.e., regular use, above the fastening section having a front and a rear side and opposing side edges, and a support section for the carrying straps located on the rear side of the hold member, wherein the retaining section and the fastening section of the hold member are separate elements which are resiliently connected, or wherein the retaining section and the fastening section of the hold member are separate elements or are in one piece and wherein the rear side of the retaining section comprises a multitude of grooves extending from one side edge to the opposing side edge.

Item 23. The hold member according to Item 22, wherein said hold member represents a dispenser adapter for transforming a T-shirt bag dispenser having two spaced apart, essentially similarly or identically oriented or orientable holding struts into a carrier bag dispenser having a front side and a rear side for holding a stack of carrier bags each having a pair of carrying straps and a pair of spaced apart holes in the upper region of the bag as well as for dispensing individual carrier bags therefrom.

Item 24. The hold member according to Item 22 or 23, wherein the retaining section and the fastening section of the hold member being separate elements are resiliently connected.

Item 25. The hold member according to any of the Items 22 to 24, wherein the retaining section and the fastening section of the hold member are resiliently connected by at least one spring screw.

Item 26. The hold member according to any of the Items 22 to 25, wherein the rear side of the retaining section comprises two, three, four, five, or six grooves that extend from one side edge to the opposing side edge.

Item 27. The hold member according to any of the Items 22 to 26, wherein at least one groove of the multitude of grooves in cross-sectional view, in use, i.e., regular use, is tilted upwards.

Item 28. The hold member according to any of the Items 22 to 27, wherein the retaining section and the support section are forming an angle in the range from 60° to 120°.

Item 29. The hold member according to any of the Items 25 to 28, wherein the at least one spring screw is located on the front side of the retaining section and wherein the fastening section comprises at least one corresponding screw thread.

Item 30. The hold member according to any of the Items 25 to 29, wherein the at least one spring screw is located in the lower part of the retaining section and/or wherein the at least one screw thread is located in the upper part of the fastening section.

Item 31. The hold member according to Item 29 or 30, wherein that section of the spring screw being positioned in the screw thread is additionally fixed to the screw thread by use of glue.

Item 32. The hold member according to any of the Items 22 to 31, wherein the support section and the fastening section are formed in one piece and resiliently connected to the separate retaining section, or wherein the support section and the retaining section are formed in one piece and resiliently connected to the separate fastening section.

Item 33. The hold member according to Item 32, wherein the transition from the fastening section to the support section on the front side is rounded, or wherein the transition from the retaining section to the support section on the front side is rounded.

Item 34. The hold member according to Item 33, wherein the resilient connection located in the upper part of the fastening section is positioned below or at the level of the support section, or wherein the resilient connection located in the upper part of the fastening section is positioned above or at the level of the support section.

Item 35. The hold member according to any of the Items 25 to 34, wherein the at least one spring screw has a lesser extension in the direction away from the front side as the at least one screw which fastens the fastening section to the carrier element.

Item 36. A kit-of-parts carrier bag dispenser for holding a stack of carrier bags each having a pair of carrying straps and a pair of spaced apart holes in the upper region of the bag as well as for dispensing individual carrier bags comprising a) a T-shirt bag dispenser having a front side and a rear side for holding a stack of T-shirt bags, the T-shirt bag dispenser comprising two spaced apart, essentially similarly or identically oriented or orientable holding struts for holding bags, a hook member having a front side and a rear side and arranged between the struts of the pair of holding struts for holding the carrying straps, and a carrier element to which the holdings struts of the pair of holding struts and the hook member are connected, and b) a hold member according to any of the Items 22 to 35.

Item 37. The kit-of-parts carrier bag dispenser according to Item 36, wherein the fastening section of the hold member is fastened to the hook member of the T-shirt bag dispenser via at least one screw or via welding.

Item 38. The kit-of-parts carrier bag dispenser according to Item 36 or 37, wherein the hook member comprises a bent wire defining a passage opening and wherein the fastening section of the hold member is fastened to the hook member by passing a screw through the passage opening.

Item 39. The kit-of-parts carrier bag dispenser according to any of the Items 36 to 38, wherein the hook member and the fastening section of the hold member are bent outwardly to the front side in a matching manner at least in sections.

BRIEF DESCRIPTION OF THE SEVERAL VIEWS OF THE DRAWINGS

Further features and advantages of the present disclosure are presented in the description below, in which preferred embodiments of the present disclosure are explained as examples with reference to schematic drawings, in which.

DETAILED EMBODIMENTS

Figure 1:
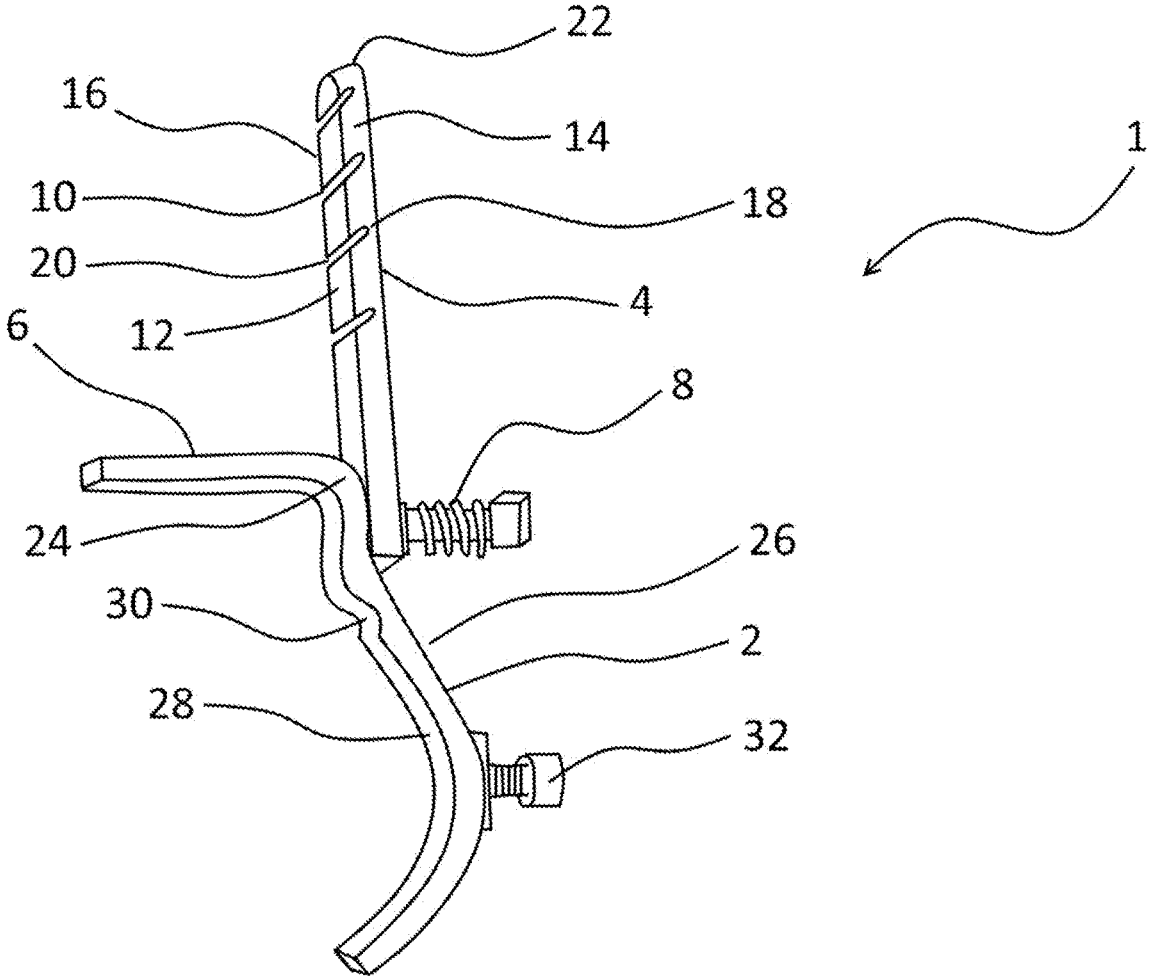
FIG. 1 shows a schematic perspective side view of a first embodiment of the hold member of the present disclosure.

According to at least one suitable embodiment, with the carrier bag dispenser according to the second variant, the hold member is made in one piece. Also with respect to the second variant, a carrier bag dispenser of the present disclosure has been found to be rather advantageous in that the retaining section and the fastening section of the hold member are separate elements which are resiliently connected, in some cases by at least one spring screw. This can, according to one embodiment, be accomplished by forming the support section and the fastening section in one piece and resiliently connect the separate retaining section, in most cases the lower part of said retaining section, to the fastening section, in most cases the upper part of said fastening section. Here, regularly the rear side of the retaining section is joined to the front side of the fastening section. According to another embodiment, this can be accomplished by forming the support section and the retaining section in one piece and resiliently attaching the separate fastening section, in most cases the upper part of said fastening section, to the retaining section, most cases the lower part of the retaining section. Here, regularly the rear side of the fastening section is joined to the front side of the retaining section. With the present disclosure, it is also possible to make use of the support section as a separate element which can be connected to the fastening section or the retaining section. In some cases it is also sufficient to bring such separate support section in close proximity to the rear side of the retaining section or the fastening section.

With the carrier bag dispensers according to the present disclosure, the rear side of the retaining section may comprise, in a rather suitable embodiment, two, three, four, five, or six grooves that extend from one side edge to the opposing side edge.

Advantageous results are also obtained in case at least one groove, in most cases at least one groove of the multitude of grooves, or according to another embodiment all grooves of the multitude of grooves are tilted upwards in cross-sectional view when the carrier bag dispenser is in use, i.e., regular use.

Moreover, in use, i.e., regular use, the retaining section is usually oriented essentially vertically. In such a manner said retaining section can function as a hook and holds back the carrying straps of the carrier bags. In some cases, the carrier straps have a width in the range from 0.5 cm to 5 cm and in some other cases from 1 cm to 4 cm, for example about 3 cm. With a pair of carrier straps, a first strap is regularly joined, e.g. glued or welded, to the inner side of the front wall of the carrier bag and the second strap is regularly joined, e.g., glued or welded, to the inner side of the rear wall of the carrier bag.

It has been found to be advantageous to employ a retaining section having a breadth in the range of 1 to 5 cm, in some cases in the range from 2 to 4 cm, for example of about 3 cm. In some pragmatic embodiments, the breadth of the fastening section and the breadth of the support section are choosing to be essentially identical to the breadth of the retaining section. The length of the retaining section is usually in the range from 4 cm to 12 cm, and in some other cases in the range from 6 to 10 cm. Further, the length of the support section can, in some embodiments, be in the range from 3 cm to 10 cm and in some further cases in the range from 4 cm to 8 cm, for example 5 cm. And, the length of the fastening section can, in some cases, be in the range from 4 cm to 12 cm, and in some other cases in the range from 6 to 10 cm.

In some cases it is rather beneficial to make use of a rounded top edge of the retaining section.

According to another embodiment, is also possible that the retaining section and the support section form an angle in the range from 60° to 120°. In some embodiments, the angle formed between the retaining section and the support section of the hold member is about 90°.

With some rather advantageous embodiments of the carrier bag dispensers according to the present disclosure, the at least one spring screw is located on the front side of the retaining section. Said at least one spring screw can be screwed into the at least one corresponding screw thread in the fastening section.

The at least one spring screw is, in some rather advantageous embodiments, located in the lower part of the retaining section. It has been found to represent a pragmatic solution to locate the at least one screw thread in the upper part of the fastening section.

Reliable results are also obtained with embodiments of the carrier bag dispensers according to the present disclosure, wherein that section of the spring screw being positioned in the screw thread is additionally fixed to the screw thread by use of glue. Here, glues can be used which are able to join metal parts.

In some embodiments the fastening section and the support section of the hold member of the carrier bag dispensers according to the present disclosure can be formed in one piece.

Rather advantageous results in terms of a sufficient degree of flexibility of the retaining section can be obtained with those embodiments of the carrier bag dispensers according to the present disclosure in which the transition from the fastening section to the support section on the front side is rounded and wherein the at least one screw thread located in the upper part of the fastening section is positioned below the support section.

The fastening section can, in one embodiment, be fastened to the carrier element by at least one screw or by gluing or welding. In case of fastening the fastening section to the carry element by use of at least one screw, a rather pragmatic solution provides that the at least one spring screw has a lesser extension in the direction away from the front side as the at least one screw which fastens the fastening section to the carrier element.

According to another embodiment, the carrier bag dispensers according to the present disclosure further comprise a stack of carrier bags each having a pair of carrying straps and a pair of spaced apart holes in the upper region of the bags, wherein the pair of struts is placed in the respective pair of spaced apart holes and the pairs of carrying straps are held by the hold member.

The present disclosure also provides a hold member for holding and retaining a multitude of pairs of straps connected to respective carrier bags. Said hold member comprises a fastening section for fastening the hold member to a bag dispenser, a retaining section located, in regular use, above the fastening section having a front and a rear side and opposing side edges, and a support section for the carrying straps located on the rear side of the hold member. Here, the retaining section and the fastening section of the hold member can, according to one embodiment, be separate elements which are resiliently connected, in some cases by at least one spring screw. According to another embodiment, the retaining section and the fastening section of the hold member are either formed as separate elements or in one piece and wherein the rear side of the retaining section comprises at least one groove, and in some advantageous cases a multitude of grooves, extending from one side edge to the opposing side edge.

Said hold member can be considered to represent a dispenser adapter for transforming a T-shirt bag dispenser having two spaced apart, essentially similarly or identically oriented or orientable holding struts, into a carrier bag dispenser having a front side and a rear side for holding a stack of carrier bags each having a pair of carrying straps and a pair of spaced apart holes in the upper region of the bag as well as for dispensing individual carrier bags therefrom. It has been found to be rather advantageous if, with the hold member, the retaining section and the fastening section of the hold member are separate elements which are resiliently connected by two spring screws. Those hold members according to the present disclosure are most suited in which the rear side of the retaining section comprises two, three, four, five, or six grooves that extend from one side edge to the opposing side edge.

And, advantageously at least one groove, and in most cases at least one groove of the multitude of grooves, or in some cases all grooves of the multitude of grooves, in cross-sectional view, in regular use, are tilted upwards.

In some rather pragmatic embodiments, the retaining section and the support section are forming an angle in the range from 60° to 120° with the hold member according to the present disclosure.

In order to resiliently fasten the fastening section to the retaining section the at least one spring screw is advantageously located on the front side of the retaining section. It is, then, rather pragmatic to provide in the fastening section at least one corresponding screw thread.

Also with the hold member according to the present disclosure, the at least one spring screw is, in one embodiment, located in the lower part of the retaining section. In addition, it can be provided that the at least one screw thread is located in the upper part of the fastening section.

In order to strengthen the connection between the retaining section and the fastening section, that part of the spring screw being positioned within the screw thread can additionally fixed to the screw thread by use of glue.

In a very advantageous embodiment of the hold member of the present disclosure, the transition from the fastening section to the support section on the front side is rounded. Here, it is also possible that the at least one screw thread can be located in the upper part of the fastening section is positioned below the support section.

The handling of carrier bags can be facilitated with those embodiments in which the at least one spring screw has a lesser extension in the direction away from the front side as the at least one screw which fastens the fastening section to the carrier element.

The present disclosure also provides a kit-of-parts carrier bag dispenser for holding a stack of carrier bags, each having a pair of carrying straps and a pair of spaced apart holes in the upper region of the bag as well as for dispensing individual carrier bags. Said kit of parts carrier bag dispenser comprises a) a T-shirt bag dispenser having a front side and a rear side for holding a stack of T-shirt bags comprising two spaced apart, essentially similarly or identically oriented or orientable holding struts for holding bags, a hook member having a front side and a rear side and arranged between the struts of the pair of holding struts for holding the carrying straps and a carrier element to which the holdings struts of the pair of holding struts and the hook member are connected, as well as b) a hold member according to the present disclosure.

With the kit-of-parts carrier bag dispenser according to the present disclosure, the fastening section of the hold member can be fastened to the hook member of the T-shirt bag dispenser via at least one screw or via welding.

It has been found to be rather advantageous to make use of a hook member which comprises or is formed of a bent wire defining a passage opening. In such a manner the fastening section of the hold member can be fastened to the hook member by passing a screw through the passage opening.

In order to safely and reliably join the hook member and the fastening section of the hold member, these are in one embodiment bent outwardly towards the front side in a matching manner at least in sections.

Due to the features of the embodiments of the present disclosure as described above, it is possible to easily and reliably modify a T-shirt bag dispenser into a carrier bag dispenser for a multitude of carrier bags each being equipped with a pair of carrying straps. In such a manner it is not necessary to design newly dimensioned carrier bags being equipped with carrying straps. Rather, conventional carrier bags having such carrying straps can be used with the carrier bag dispenser of the present disclosure. A multitude of carrier bags in the meaning of the present disclosure in one embodiment comprises in the range from 2 to 100 carrier bags, in some cases from 10 to 80 carrier bags, and in some other cases from 20 to 70 carrier bags. It comes without saying that the carrier bag dispensers of the present disclosure as well as the hold member of the present disclosure can also be used with a single carrier bag.

From FIG. 1, a schematic side view representation of a first embodiment of the hold member 1 according to the present disclosure can be derived. Said hold member 1 comprises a fastening section 2, a retaining section 4, and a support section 6. While the fastening section 2 and the support section 6 are formed in one piece in the embodiment depicted in FIG. 1, the retaining section 4 forms a separate component which is resiliently connected to the front side of the upper part of the fastening section 2 by use of spring screws 8. The retaining section 4 can be formed of a metal plate. In an advantageous embodiment as depicted in FIG. 1, said retaining section 4 is equipped with a multitude of grooves 10 on its rear side 12. Said grooves are spaced apart from each other and are extending from one side edge 14 to the opposite side edge 16 of the retaining section 4. In regular use, the retaining section 4 is usually vertically oriented. In this case the grooves 10 are tilted upwards, that is, the bottom 18 of said grooves is lying slightly above the entry 20 of said grooves. In this manner it has been found to be rather efficient to prevent carrying straps from slipping over the top 22 of the retaining section 4. In regular use, the carrying straps of a multitude of carrier bags are placed over the retaining section 4 and can rest on the support section 6. As can be derived from FIG. 1, the transition zone 24 between the support section 6 and the fastening section 2 is rounded. This design greatly facilitates resilient movement of the retaining section 4. In the embodiment depicted in FIG. 1, the middle and lower part of the fastening section 2 is bent outwardly towards the front side 26, that is that side which is approached by the customer or the sales personnel to take a bag from the hold member 1. On the rear side 28 of the fastening section 2, groove 30 is provided in the upper part. Such groove can be used to engage with an edge or a tube or a wire of, for example, a dispenser carousel or of the bag dispenser unit to which the hold member 1 is fastened by use of the screw 32.

Figure 2:
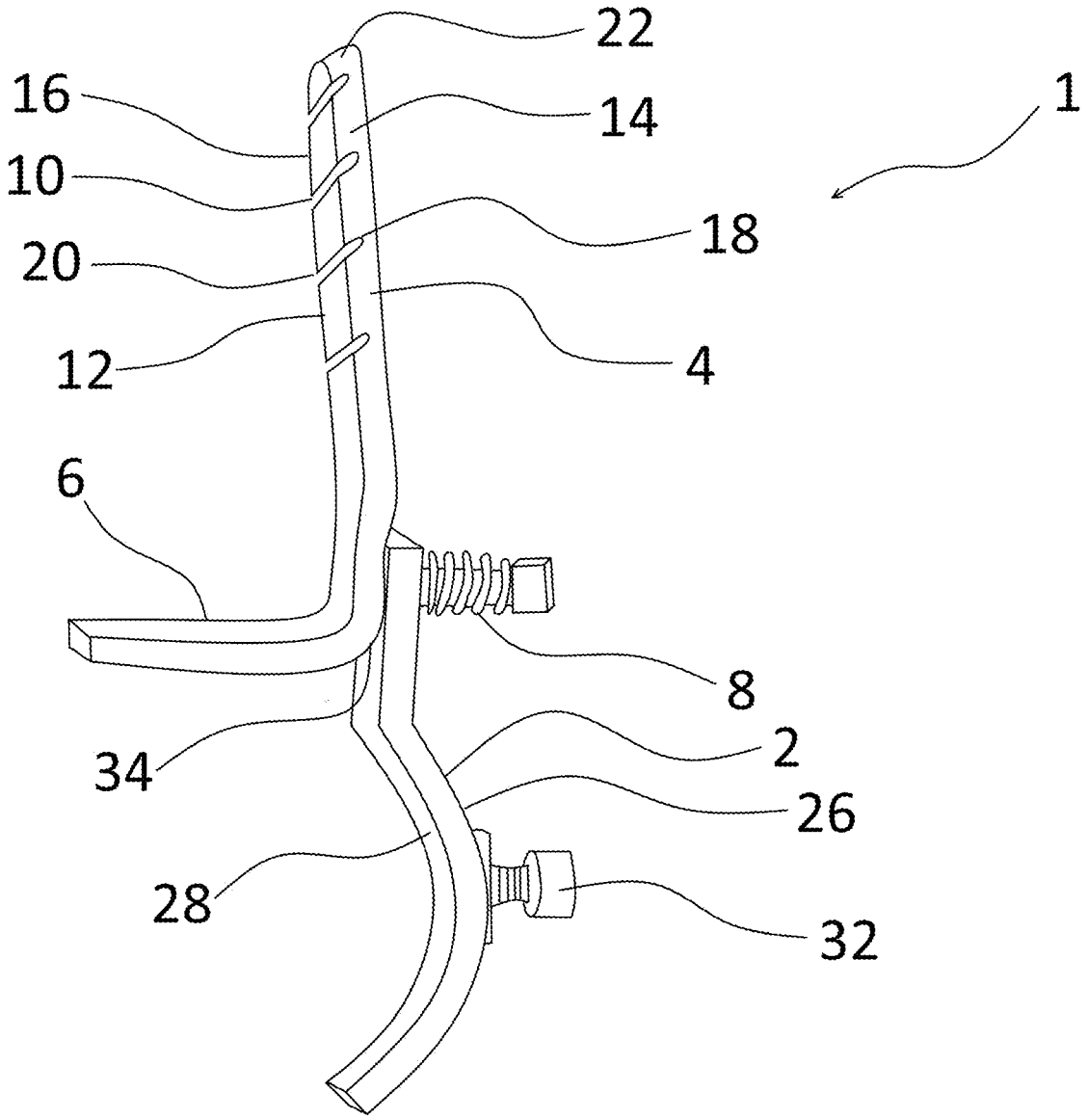
FIG. 2 shows a schematic perspective side view of a second embodiment of the hold member of the present disclosure.

From FIG. 2, a schematic side view representation of a second embodiment of the hold member 1 according to the present disclosure can be derived. Said hold member 1 comprises a fastening section 2, a retaining section 4, and a support section 6. While the retaining section 4 and the support section 6 are formed in one piece in the embodiment depicted in FIG. 2, the fastening section 2 forms a separate component which is resiliently connected to the front side of the lower part of the retaining section 4 by use of spring screws 8. The fastening section 2 can be formed of a metal plate. As with the embodiment of FIG. 1, the retaining section 4 is equipped with a multitude of grooves 10 on its rear side 12. As can be derived from FIG. 2, the transition zone 34 between the support section 6 and the retaining section 4 is rounded. This design also facilitates resilient movement of the retaining section 4.

Figure 3:
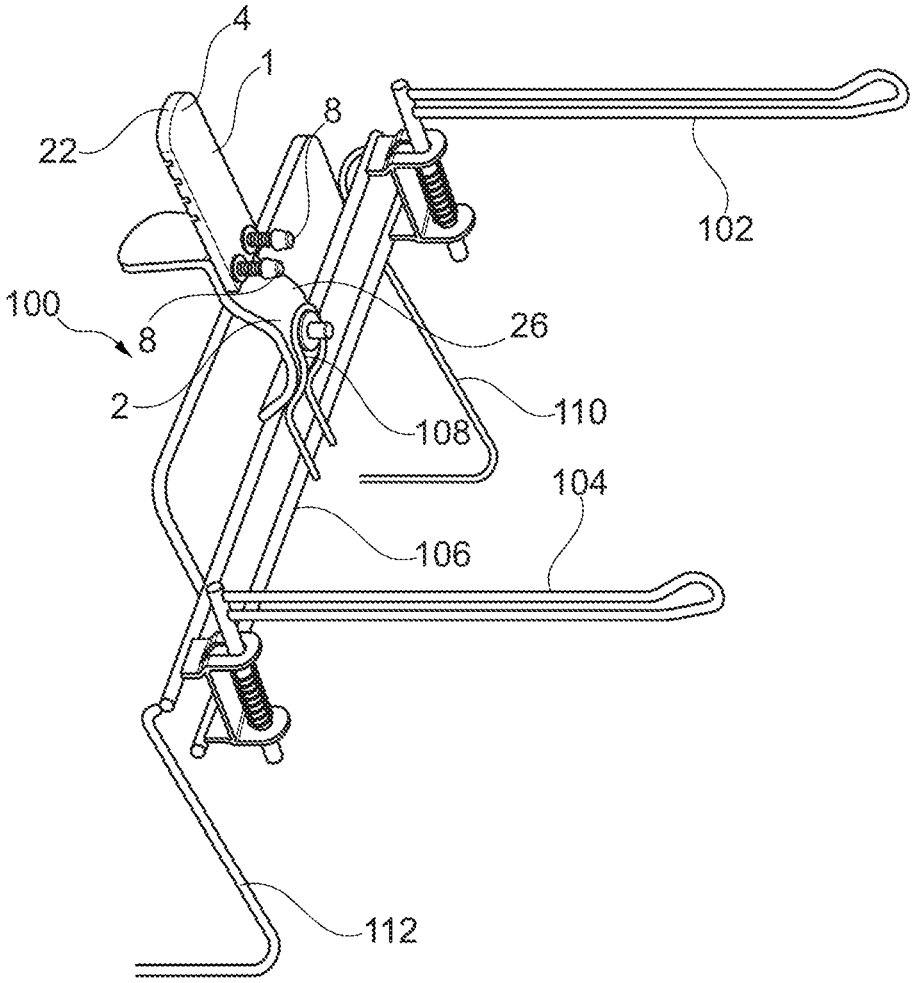
FIG. 3 shows a schematic perspective front side view of the carrier bag dispenser of the first variant of the present disclosure

In FIG. 3, an embodiment of the first variant of the carrier bag dispenser 100 of the present disclosure is depicted. Said carrier bag dispenser 100 comprises a pair of holding struts 102 and 104 which are movably connected to a carrier unit 106. Carrier bags having a pair of holes in the upper part of the bag can be used to place said carrier bags on said holding struts. Moreover, a hold member 1, as outlined above and shown in FIG. 1, is attached to the carrier unit 106 and is located centrally between the pair of struts. In the embodiment depicted in FIG. 3, a hook member 108 in the form of a bent wire is part of the carrier unit 106. Without the hold member 1, the carrier unit 106 containing the hook member 108 and the pair of holding struts 102, 104 form or are part of a T-shirt bag dispenser. For T-shirt bags equipped with a tab having a horizontal slit, said hook member 108 can be used for providing an additional temporary fastening means for the T-shirt bags in a stack of such bags. With the present disclosure, said hook member 108 is used for fastening the fastening section 2 of the hold member 1 thereto. The curvature of the middle and lower part of the fastening section 2 essentially corresponds to the curvature of the hook member 108. Here, the front side 26 of the fastening section 2 is placed against the rear side of the wire-like hook member 108. In that the holding struts are movable towards each other, also rather large stacks of carrier bags can be used with the carrier bag dispensers of the present disclosure. By turning the holding struts towards each other while holding a multitude of carrier bags, the carrying straps can even be more easily placed above the top edge 22 of the retaining section 4. This operation is also greatly assisted by said retaining section 4 being resiliently movable due to the spring screws 8 on the front side 26 of said retaining section 4. In FIG. 3, the carrier bag dispenser 110 of the present disclosure is equipped with supporting feet 110 and 112. These supporting feet are purely optional. For example, the carrier bag dispenser of the present disclosure may also be connected to or being part of a dispenser carousel. It just needs to be taken care of arranging the carrier bag dispenser of the present disclosure at a height which is convenient for the customer or sales personnel.

The features of the present disclosure disclosed in the above description, in the claims and in the drawings can be essential both individually and in any combination required for the realization of the present disclosure in its different embodiments.

The invention claimed is:

1. A hold member for holding and retaining a multitude of pairs of carrying straps connected to respective carrier bags, wherein said hold member comprises:

a fastening section for fastening the hold member to a bag dispenser, a retaining section located, in use, above the fastening section having a front side, a rear side, and opposing side edges, and a support section for the carrying straps located on the rear side of the hold member, wherein the rear side of the retaining section comprises a multitude of grooves extending from one side edge to an opposing side edge, and wherein the retaining section and the fastening section of the hold member are resiliently connected by at least one spring screw.

2. The hold member according to claim 1, wherein said hold member represents a dispenser adapter for transforming a T-shirt bag dispenser having two spaced apart, essentially similarly or identically oriented or orientable holding struts into a carrier bag dispenser having a front side and a rear side for holding a stack of carrier bags each having a pair of carrying straps and a pair of spaced apart holes in the upper region of the bag as well as for dispensing individual carrier bags therefrom.

3. The hold member according to claim 1, wherein the retaining section and the fastening section of the hold member are separate elements and are resiliently connected.

4. The hold member according to claim 1, wherein the multitude of grooves at the rear side of the retaining section comprises two, three, four, five or six grooves that extend from one side edge to the opposing side edge.

5. The hold member according to claim 1, wherein at least one groove of the multitude of grooves in cross-sectional view, in use, is tilted upwards.

6. The hold member according to claim 1, wherein the retaining section and the support section are forming an angle in the range from 60° to 120°.

7. The hold member according to claim 1, wherein the at least one spring screw is located on the front side of the retaining section, and wherein the fastening section comprises at least one corresponding screw thread.

8. The hold member according to claim 7, wherein a section of the at least one spring screw is positioned in the screw thread and additionally fixed to the screw thread by use of glue.

9. The hold member according to claim 1, wherein the at least one spring screw is located in a lower part of the retaining section.

10. The hold member according to claim 1, wherein the support section and the fastening section are formed in one piece that is resiliently connected to the retaining section being separate therefrom.

11. The hold member according to claim 10, wherein a transition from the fastening section to the support section on the front side is rounded.

12. The hold member according to claim 10, wherein the resilient connection is located in an upper part of the fastening section and is positioned below or at level of the support section.

13. The hold member according to claim 7, wherein the at least one spring screw has a lesser extension in a direction away from the front side as at least one screw fastens the fastening section to a carrier element.

14. The hold member according to claim 7, wherein the at least one screw thread is located in an upper part of the fastening section.

15. The hold member according to claim 10, wherein a transition from the retaining section to the support section on the front side is rounded.

16. The hold member according to claim 1, wherein the fastening section has a rear side, and a groove is provided in an upper part of the rear side of the fastening section.

17. The hold member of claim 16, wherein said groove of the fastening section is configured to engage with an edge or a tube or a wire of a dispenser carousel or a bag dispenser unit.

18. The hold member of claim 16, wherein said groove of the fastening section extends from one side of the fastening section to an opposite side of the fastening section.

19. The hold member of claim 16, wherein said groove of the fastening section has a rounded cross-sectional shape.

* * * * *